US008176868B2

(12) United States Patent
Han

(10) Patent No.: US 8,176,868 B2
(45) Date of Patent: May 15, 2012

(54) SYSTEM AND METHOD FOR CONNECTING MARINE BODIES

(76) Inventor: Lei Han, Singapore (SG)

( * ) Notice: Subject to any disclaimer, the term of this patent is extended or adjusted under 35 U.S.C. 154(b) by 779 days.

(21) Appl. No.: 12/301,994

(22) PCT Filed: Jan. 18, 2006

(86) PCT No.: PCT/SG2006/000008
§ 371 (c)(1),
(2), (4) Date: Nov. 21, 2008

(87) PCT Pub. No.: WO2007/084074
PCT Pub. Date: Jul. 26, 2007

(65) Prior Publication Data
US 2009/0151616 A1 Jun. 18, 2009

(51) Int. Cl.
*B63B 35/44* (2006.01)

(52) U.S. Cl. ..... 114/267

(58) Field of Classification Search ..... 114/263–267, 114/343, 364, 292
See application file for complete search history.

(56) References Cited

U.S. PATENT DOCUMENTS 3,221,696 A 12/1965 Gardner
4,060,048 A * 11/1977 Breheret et al. ..... 114/266
5,803,007 A * 9/1998 Stevens ..... 114/266

FOREIGN PATENT DOCUMENTS

EP 0272739 A1 6/1988
WO 2004024555 A1 3/2004

* cited by examiner

*Primary Examiner* — Daniel Venne

(57) ABSTRACT

A coupling to engage and retain two adjacent buoyant marine bodies in a side to side abutting relationship, is described. The coupling has two coupling portions (9), one each on one of the two adjacent buoyant marine bodies. The coupling portion ("first coupling portion") including a downwardly directed receiving recess that includes at least one bearing surface (7) that faces away from a plane of abutment of the two marine bodies and that increases in distance away from the plane of abutment from top to bottom. The coupling also having a locking bar to be retained by the other coupling portion (second coupling portion) in a manner to allow it to move vertically thereto and to project from the second coupling portion for engagement with the first coupling portion, the locking bar including a receiving surface (16) to abut with the bearing surface (7). The relative movement of the two marine bodies together causes the locking bar to drop down the receiving recess thereby holding the two marine bodies together, in more restrained juxtaposition.

11 Claims, 10 Drawing Sheets

SYSTEM AND METHOD FOR CONNECTING MARINE BODIES

RELATED PATENT DATA

This application claims priority to Patent Cooperation Treaty application Serial No. PCT/SG2006/000008, which was filed Jan. 18, 2006.

FIELD OF INVENTION

The present invention relates to a system for connecting at least two buoyant marine bodies together and in particular although not solely to securing pontoons together in an end-to-end and/or side-to-side relationship.

BACKGROUND

Floating marine bodies such as platforms, including pontoons or barges often need to be joined together to create a larger overall working surface such as to define a bridge or the like. Such platforms can also be utilised as a floating base for marine vehicle refilling or troop loading and to support helicopter operations, to isolate risky operations or similar situations.

However the key technical challenge for constructing such joined floating platforms lies in the connector design, which must address the difficulties relating to the relative motion between two platforms particularly in rough seas during the connection operation. The connector design must be able to sustain the dynamic forces as a result of the wave motion both during and once the connection has been established.

The relative vertical motion of two platforms can result in a relative movement between the two connecting units of more than 0.5 m (when for example a platform is 40 m long and 7 m wide and operating in sea state three). In such conditions it would be very difficult for the operator to catch the right timing when the two platforms are in a condition where the connection units are aligned in order to connect the platforms together manually. It is also extremely dangerous to the operator working at the edges of the platform as these not only move up and down but can also knock together. Such movement may be sufficient to knock the operator from his/her feet and thereby potentially causing serious or fatal injuries.

Several designs have addressed various problems with connecting two platforms together and such designs have been mentioned for example in the patent specifications of U.S. Pat. No. 4,290,382, U.S. Pat. No. 3,386,117, U.S. Pat. No. 4,695,184, JP 20203488 and U.S. Pat. No. 5,606,929. The devices mentioned in these patent specifications all utilise a guided coupling pair, which allows for the two platforms to become increasingly aligned as the two platforms are brought together. However the coupling pairs are still in a rigid form and can cause significant impact loading on each other particularly when the engagement projection is not complete.

It is accordingly an object of the present invention to provide a system for connecting at least two buoyant marine bodies together which at least goes someway to overcoming the disadvantages of the prior art, or which will at least provide industry or the public with a useful choice.

BRIEF DESCRIPTION OF THE INVENTION

In a first aspect the present invention may be said to broadly consist in a coupling to engage and retain two adjacent buoyant marine bodies in a side to side abutting relationship, said coupling comprising:

two coupling portions, one each on one of said two adjacent buoyant marine bodies;

at least one said coupling portion ("first coupling portion") including a downwardly directed receiving recess that includes at least one bearing surface that faces away from a plane of abutment of said two marine bodies and that increases in distance away from said plane of abutment from top to bottom; and a locking bar to be retained by said other coupling portion ("second coupling portion") in a manner to allow it to move vertically thereto and to project from said second coupling portion for engagement with said first coupling portion, said locking bar including a receiving surface to abut with said bearing surface, wherein relative movement of said two marine bodies together causes said locking bar to drop down said receiving recess thereby holding said two marine bodies together, in more restrained juxtaposition.

Preferably said recess has a vertical slot opening through which said locking bar extends, said slot opening being of a length to allow movement downwards of said locking bar.

Preferably said locking bar is restrained from riding up said recess by friction between said bearing surface and said receiving surface.

Preferably there are two locking bars per recess, a shorter upper locking bar, and a longer lower locking bar.

Preferably said longer lower locking bar passes said upper region of said recess and comes to settle at said lower region of the recess.

Preferably said shorter upper locking bar engages the recess at its upper region.

Preferably said marine bodies are restrained from movement in directions parallel to the plane of abutment.

Preferably said locking bar resists relative motion of said first and second coupling portions perpendicular to said plane of abutment.

Preferably said two locking bars resist rotational movement of said two bodies about a horizontal axis parallel to the plane of abutment.

Preferably said recess provides two said bearing surfaces, one either side of said vertical slot, said recess defining a T shape in plan view.

Preferably both said first and second coupling portions have a T-shaped recess.

Preferably said locking bar has a "T" shaped end.

Preferably said locking bar is a dog bone shape.

Preferably said bearing surfaces are on a post within said recess.

Preferably said locking bar is elongated and has through apertures at the distal ends, said through aperture having said receiving surface.

Preferably having a securing post on said coupling portion, and a securing bar, said securing bar including apertures to secure said post to said securing post.

Preferably said apertures are through apertures.

Alternatively said apertures are through partial apertures and the top of said securing bar is in use substantially level with the deck of said buoyant marine bodies Preferably said the receiving surface(s) on said locking bar is/are complementary the bearing surfaces.

Preferably the abutting surfaces of said adjacent buoyant marine bodies are substantially straight (when viewed in plan view).

Preferably at least one of said adjacent buoyant marine bodies is a barge.

Preferably said adjacent buoyant marine bodies are pontoons.

In a second aspect the presenting invention consists in a two marine bodies to be held together, each marine body including at least two couplings as herein before described.

In yet another aspect the present invention consists in a floating marine structure, said structure comprising of a plurality of buoyant marine bodies each incorporating at least one coupling as herein before described.

Preferably each marine body is identical.

Preferably a said coupling is provided at the bow and stern of each marine body to allow end to end connection of a plurality of marine bodies.

In a further aspect the present invention consists in a coupling hold two adjacent floating marine bodies together to prevent their horizontal separation said coupling comprising:

a dog bone shaped connector to extend between said bodies; and a vertically extending recess provided by each said body each said recess being of a shape to receive an end of said connector and including at least one surface to capture and restrict the movement of said end of said connector towards the floating body with which the other end of said connector is engaged, wherein said surface(s) at upper regions of said recess are proximate more the other body than lower regions of said recess wherein a movement of said bodies together will result in a dropping downwardly of said connector within each recess to progressively restrict the hold said floating bodies in more restrained juxtaposition.

Preferably there are two dog bone shaped connectors, a shorter upper connector bar, and a longer lower connector.

Preferably said longer lower connector passes said upper region of said recess and comes to settle at said lower region of the recess.

Preferably said shorter upper connector engages the recess at its upper region.

In a further aspect the present invention consists in a coupling holding two adjacent floating marine bodies together to prevent their horizontal separation said coupling comprising:

an elongated connector to extend between said bodies, said elongated connector having two apertures one at each distal end; and a vertically extending recess provided by each said body each said recess being of a shape to receive an end of said connector and including a post shaped to receive said aperture, said post having at least one surface to capture and restrict the movement of said end of said connector towards the floating body with which the other end of said connector is engaged, wherein said surface(s) at upper regions of said recess are proximate more the other body than lower regions of said recess wherein a movement of said bodies together will result in a dropping downwardly of said connector on said post within each recess to progressively restrict and hold said floating bodies in more restrained juxtaposition.

Preferably there are two elongated connectors, a shorter upper connector bar, and a longer lower connector.

Preferably said longer lower connector passes said upper region of said recess and comes to settle at said lower region of the recess.

Preferably said shorter upper connector engages the recess at its upper region.

Preferably having a securing post on said coupling portion, and a securing bar, said securing bar including apertures to secure said post to said securing post.

Preferably said apertures are through apertures.

Alternatively said apertures are through partial apertures and the top of said securing bar is in use substantially level with the deck of said buoyant marine bodies.

In a further aspect the present invention consists in a method of joining two adjacent floating marine bodies having the coupling as hereinbefore described comprising aligning said bodies together and inserting said connector(s).

In a further aspect the present invention consists in a method of joining two adjacent floating marine bodies as hereinbefore described including the steps of:

aligning said bodies together;

inserting said connector(s); and inserting said securing bar.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The term 'comprising' as used in this specification means 'consisting at least in part of', that is to say when interpreting statements in this specification which include that term, the features, prefaced by that term in each statement, all need to be present but other features can also be present.

DETAILED DESCRIPTION OF THE INVENTION

Figure 1:
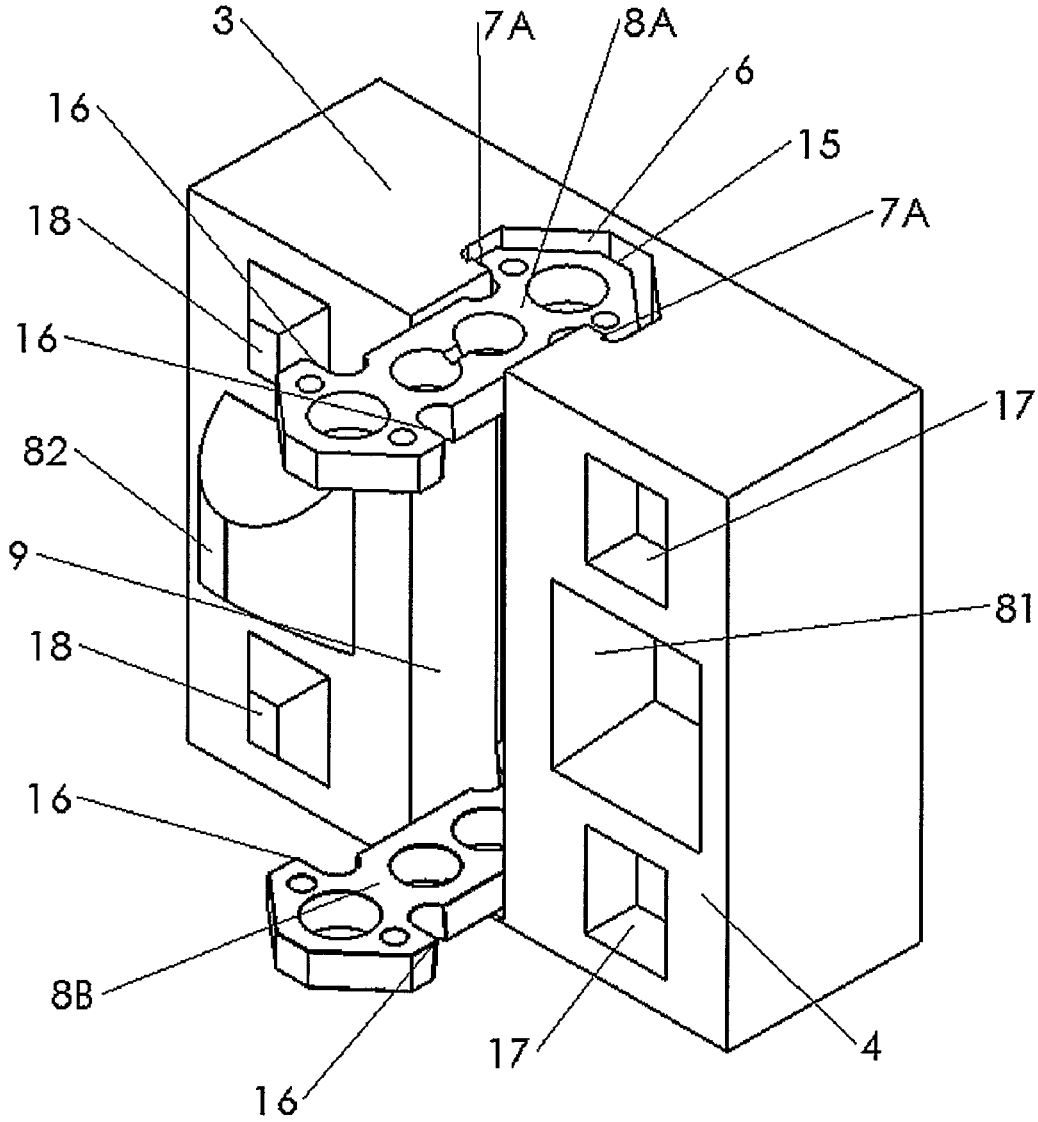
FIG. 1 shows an isometric view of a coupling portion/half and locking members engaged therein.
Figure 2:
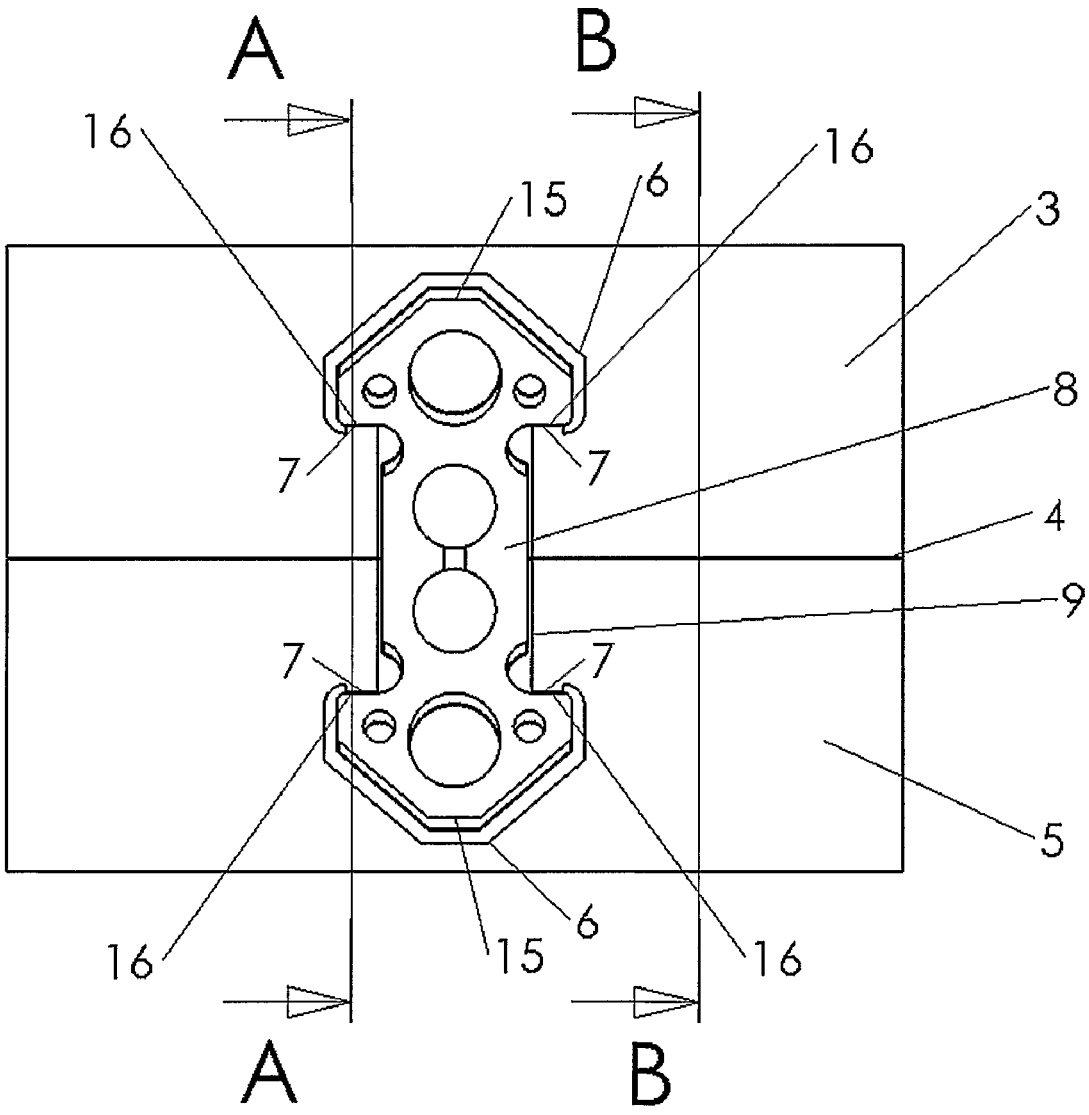
FIG. 2 shows a plan view of a pair of coupling portions/halves illustrated in FIG. 1 showing the two coupling portions/halves and locking members engaged therein.
Figure 3:
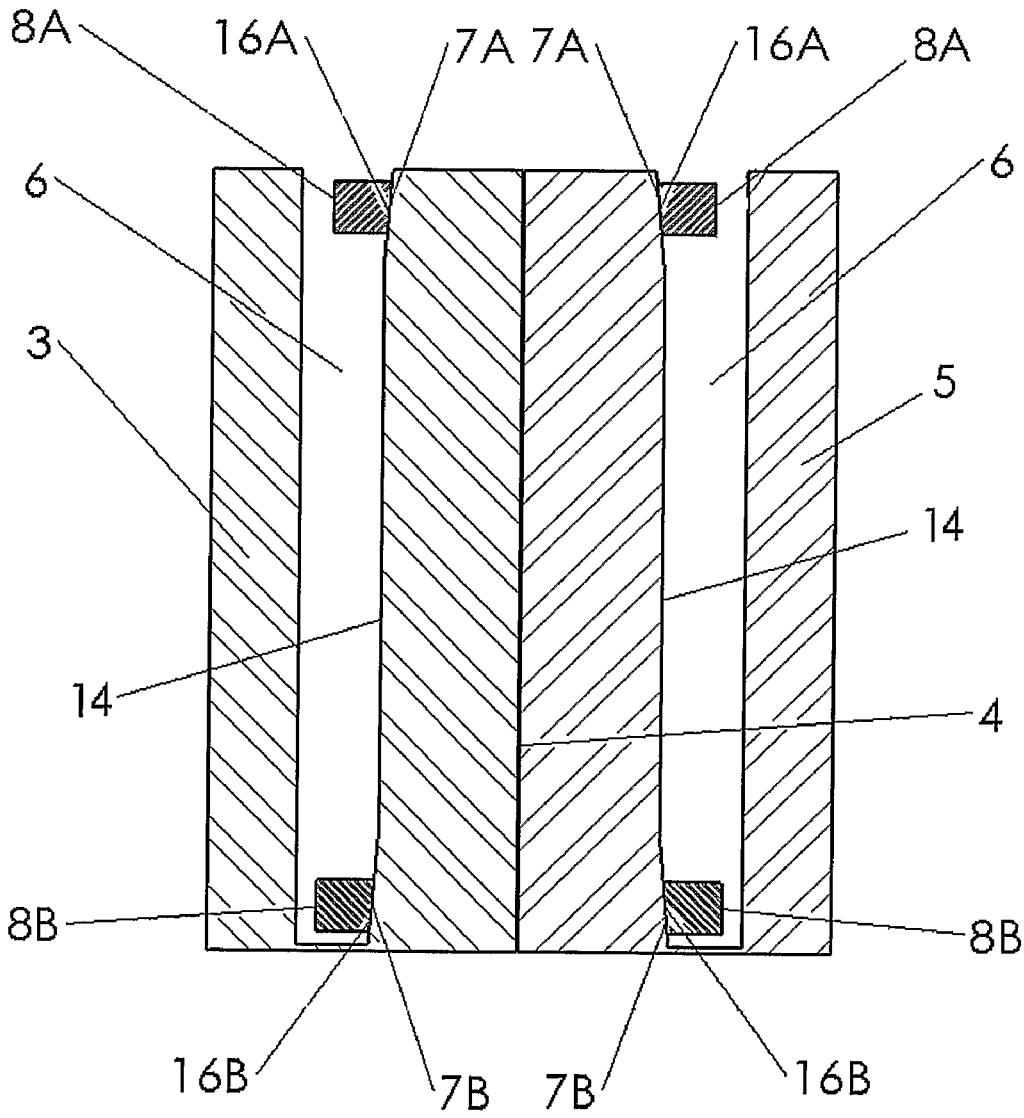
FIG. 3 shows section AA along line AA of FIG. 2 showing the upper shorter locking bar and lower longer locking bar engaging on tapered surfaces within T slots in the two portions/halves of the coupling system.
Figure 4:
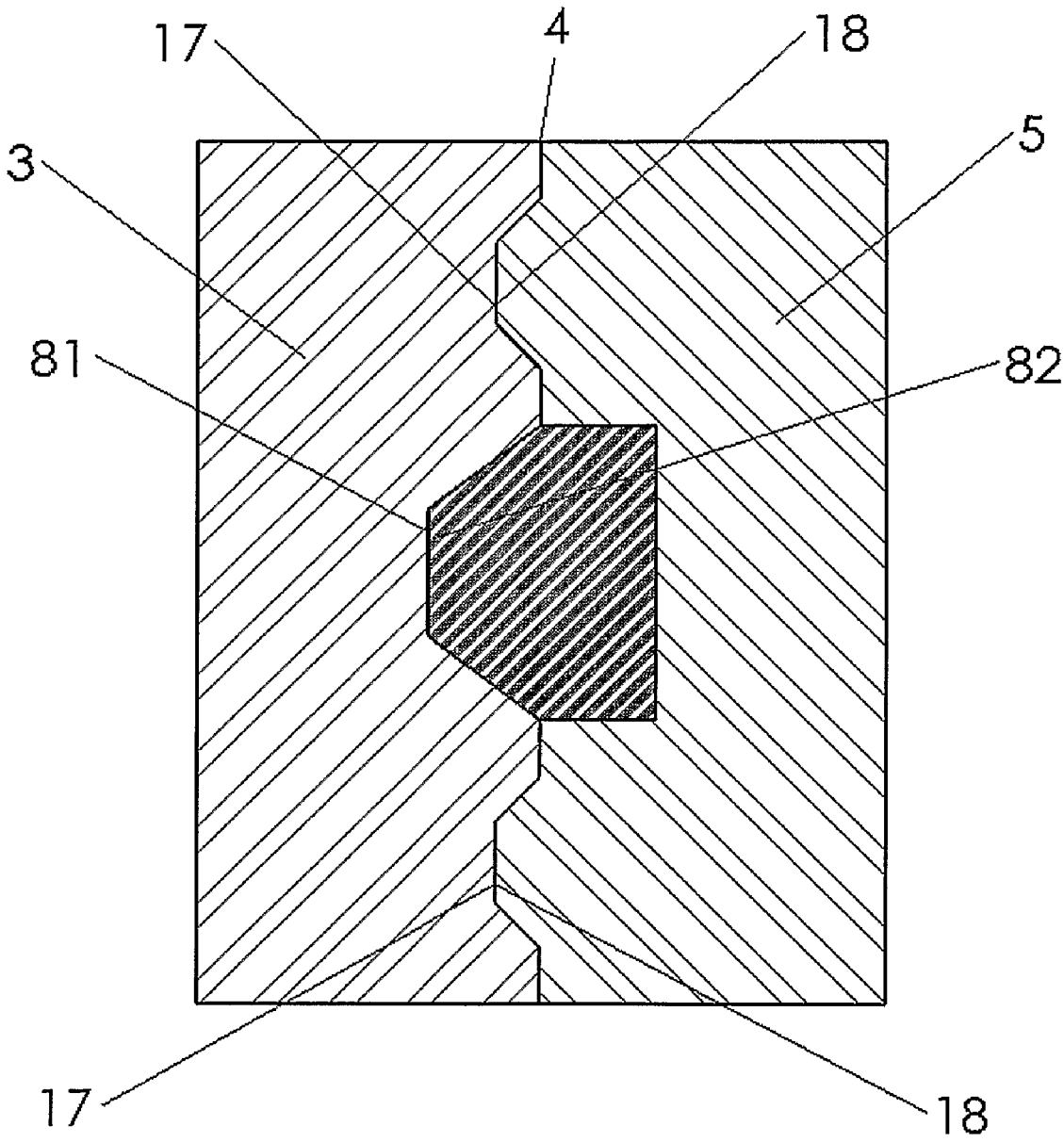
FIG. 4 shows section BB along line BB of FIG. 2 showing the complimentary engagement of the recess and projection and also the resilient nature of one recess and projection.

With reference to FIGS. 1 through 6 there is shown a buoyant marine body such as a pontoon 10, which has provided at, at least one side thereof, first and second coupling portions 3 and 5 respectively for the engaging the pontoon 10 with a similar or like pontoon. The pontoon 10 may also be a barge, platform or other buoyant marine body or vessel and which is engageable to like bodies or vessels to form a greater overall floating arrangement. By way of example, pontoons in military applications may be used to form a bridge 13 over a body of water. Likewise pontoons 10 may be joined together and be positioned adjacent a vessel 11 for the purposes of establishing a working surface 12 which is more proximate to the water level adjacent a larger vessel 11 as show in FIG. 6. Other applications include breakwater construction, ship to ship bridging, ship to shore bridging, a marine jetty and to provide the floatation pontoons for fish farm enclosure. In fact any time that a floating temporary or permanent easily erected marine structure needs to be created the present invention may find application.

In a usual form such a pontoon 10 will be of a square or rectangular plan shape and will provide four sides which may for example be considered a bow and stern and port and starboard side. The present invention is not limited to the provision of the coupling features at only one side/end of the pontoon and indeed such may be provided at any side or any number of the sides. In the application where the pontoons are used for defining a bridge structure 13, the bridge is normally defined by the positioning of pontoons 10 in a bow to stern manner and hence in this form it will the shorter length bow and stern sides of the pontoon which are provided with the securing features. Other forms of pontoons may be of more than four sides for example but not limited to hexagonal or octagonal.

The pontoons to be joined could if not secured move relative to each other on the surface of water they are buoyant on.

Pontoons are normally joined on vertical parallel faces or abutting surfaces 4 and these define a vertical interface plane. The present invention prevents movement in the horizontal direction parallel to the plane (x, first direction) and in the horizontal direction perpendicular to the plane (y, second direction). It will also prevent movement parallel to the plane in the vertical direction (z, third direction). Torsion about each of these directions is substantially prevented also. The inter-pontoon joint of the present invention creates a rigid interface between adjacent pontoons thus creating a large stable buoyant marine structure.

The pontoons 10 of such a system are preferably substantially identical and the coupling features provided at such opposing ends are substantially complimentary shaped and similarly spaced on each pontoon to be joined. A first coupling half or portion 3 is provided on at least one side of a pontoon 10 and comprises a first male coupling member 82 which is to engage with a female coupling member 81 of an adjacent pontoon. Two pontoons when floating on water have the first half coupling 3 and second half 5 coupling positioned at a height which is substantially the same relative to the waterline.

The structure on one half coupling will now be described. The second or mating half coupling is substantially identical. While the couplings have been described as a coupling half it is to be understood that one of the coupling portions may be larger than the other.

The first half coupling 3 has a downwardly directed receiving aperture 6. When the first coupling half and second coupling half are brought together they abut one another at a frictional interface 4. In the preferred embodiment there are two bearing surfaces 7 either side of a vertical slot 9. The slot 9 opens from the aperture 6 to the frictional interface 4. Shown in FIG. 3 there is an upper bearing surface set 7A and lower bearing surface set 7B.

The bearing surfaces 7 increase in distance away from the frictional interface as they move toward the bottom of the aperture 6. This may be achieved by a linear taper or angle surface but may also be achieved by a curved surface. The upper bearing surface 7A is recessed back from surface 14. The lower bearing surface 7B sits proud of surface 14.

A locking bar 8 is present that has distal ends 15 shaped to fit within the aperture 6. In the preferred embodiment the distal ends 15 are T shaped. The locking bar 8 has receiving surfaces 16 for each bearing surface 7 that it is to engage. The receiving surfaces 16 are profiled to compliment its bearing surface 7 this gives a greater area of contact between the locking bar and the coupling half. Either or both the receiving 19 or bearing surfaces 7 may be profiled.

Each locking bar 8 has distal ends spaced so that when the receiving surfaces 16 are engaged on their respective bearing surfaces 7 the locking bar will sit approximately at mid height on the bearing surface 7. In the preferred embodiment the upper locking bar sits below the surface of the entrance to the aperture 6.

The lower locking bar 8B is of slightly longer length between distal ends to allow it to fall to the lower bearing surface 7B before engaging and thus it will clear the upper bearing surface 7A. The upper locking bar 8A is shorter to fall into the aperture 6 and engage only the upper bearing surface 7A and thus be stopped there.

The aperture 6 may be substantially closed at the bottom to prevent the locking bars 8A and 8B from falling out the bottom of the aperture 6. However there may be holes present to allow the removal of water and debris from the aperture 6 to clean the aperture, for example prior to assembly.

In another embodiment the locking bars are staple shaped and have tapered receiving faces on the inner facing surfaces of the vertical legs. These, in a similar way to the locking bars above, engage with like contoured bearing surfaces and pull the two half couplings together as the locking bar moves down into the apertures.

The location of the locking bars 8 in the aperture 6 of two adjacent half couplings will create a rigid join between the adjacent pontoons. The pontoons then cannot move in any of the three directions.

The presence of the frictional interface 4 between adjacent couplings increases the rigidity of the interface. The couplings each have complimentary recesses 17 and projections 18 arrayed either side of the vertical slot 9. For example the upper left hand side of one half coupling may have a projection 18 and the mating other half coupling will have a complimentary projection. Thus when the two half couplings are brought together the recesses and projections engage and impart further rigidity to the frictional interface. The engagement adds torsional rigidity and helps prevent relative movement in all three directions.

In preferred embodiments there is energy absorbing material between a recess 81 and its complimentary projection 82. This removes some of the rigidity to allow the join to absorb energy rather than break. Such material may be a high density rubber or similar suitable material. The locking bars and coupling halves are made from in the preferred embodiment high tensile steel, although other suitable materials may be used.

Referring to FIGS. 7 to 11 an alternative embodiment of the invention will now be described. The mating half couplings are substantially identical. While the couplings have been described as a coupling half it is to be understood that one of the coupling portions may be larger than the other.

Figure 9:
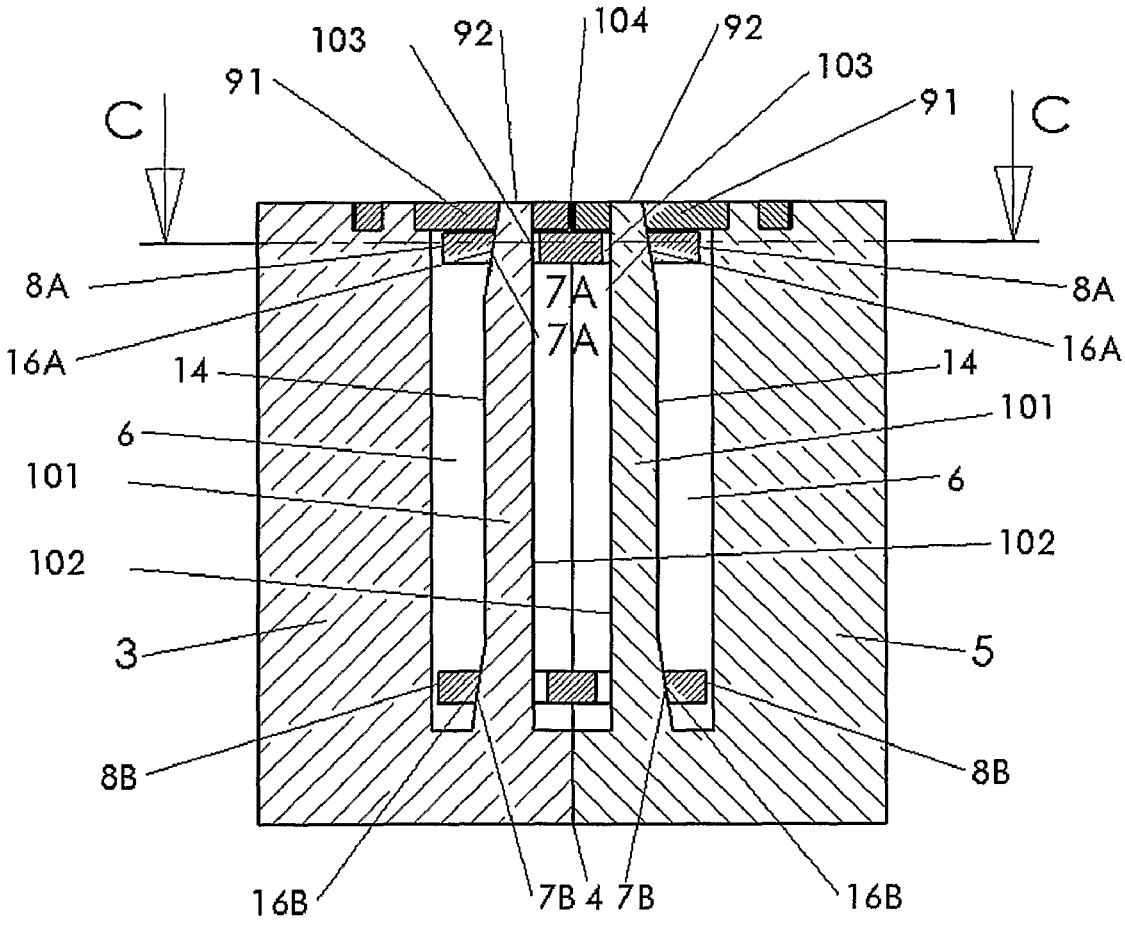
FIG. 9 shows section AA along line AA of FIG. 7 showing the upper shorter locking bar and lower longer locking bar engaging on tapered surfaces on the posts of the two portions/halves of the coupling system.
Figure 10:
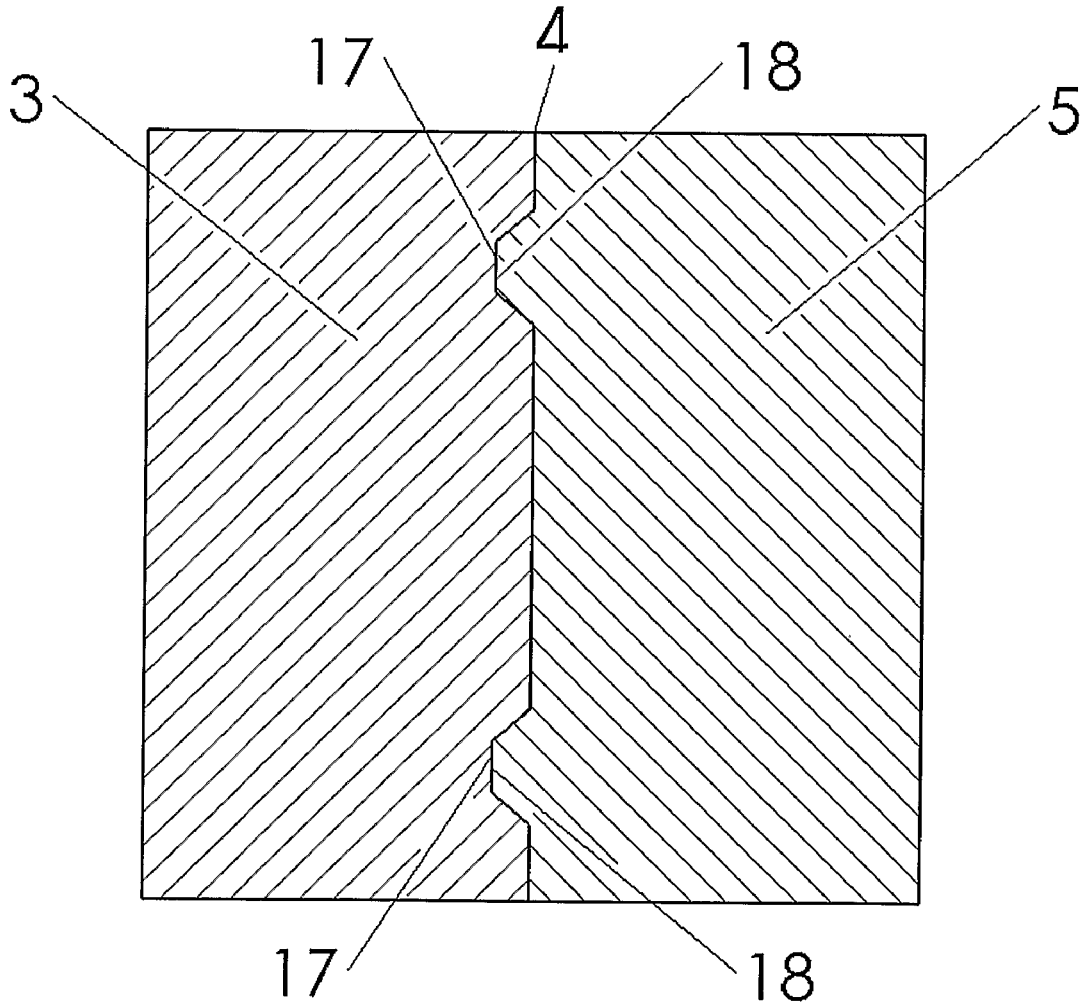
FIG. 10 shows section BB along line BB of FIG. 7 showing the complimentary engagement of the recess and projection.
Figure 11:
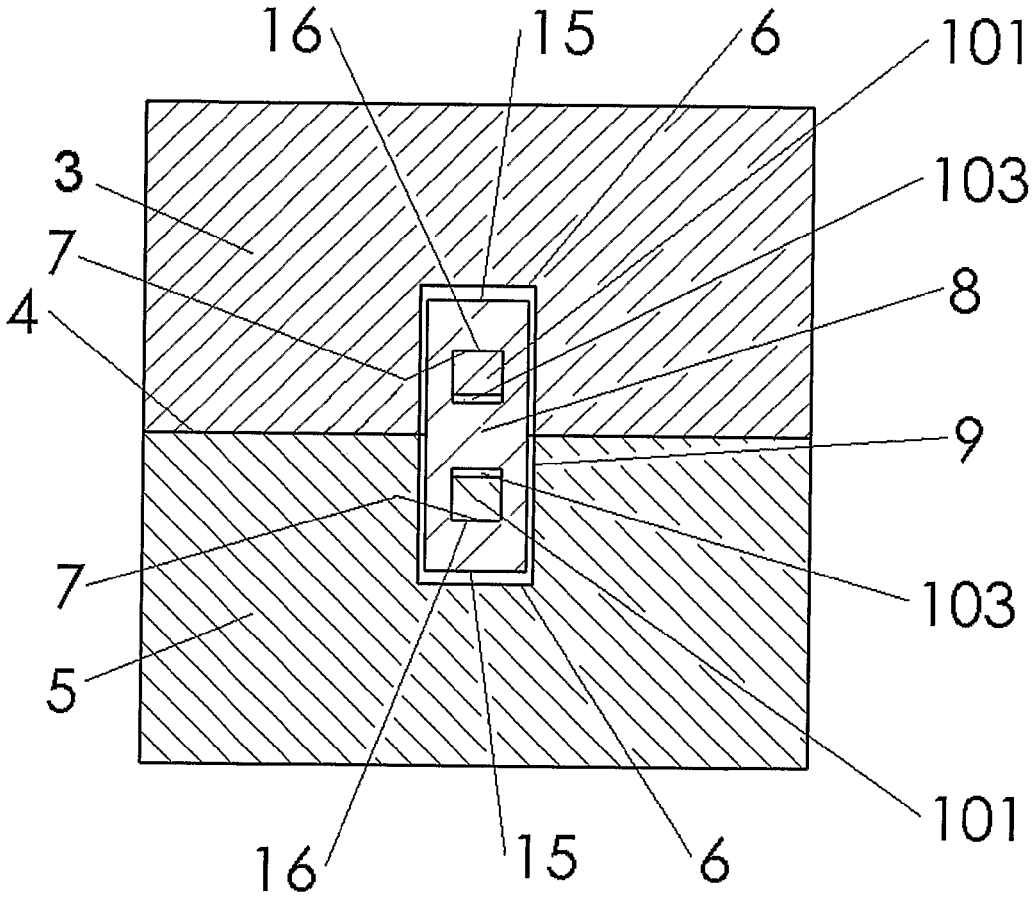
FIG. 11 shows section CC along line CC of FIG. 9 showing a plan view of the locking bar engaged.

The first half coupling 3 has a downwardly directed receiving aperture 6. When the first coupling half and second coupling half are brought together they abut one another at a frictional interface 4. There is in each receiving aperture a post 101. As shown in FIG. 9 there is an upper bearing surface set 7A and lower bearing surface set 7B on each post 101.

The bearing surfaces 7 increase in distance away from the frictional interface 4 as they move toward the bottom of the aperture 6. This may be achieved by a linear taper or angle surface but may also be achieved by a curved surface. The upper bearing surface 7A is recessed back from surface 14. The lower bearing surface 7B sits proud of surface 14. The opposite side of the post 101 to the bearing surfaces 102 is substantially straight. While the posts 101 are illustrated as rectangular they may be square, round or oval.

An elongated locking bar 8 is present that shaped to fit within the aperture 6. In the preferred embodiment the locking bar 8 is rectangular although or suitable shapes may be used. The locking bar 8 has through apertures shaped in accordance with the shape of the post 101. The locking bar 8 has receiving surfaces 16 for each bearing surface 7 that it is to engage. The receiving surfaces 16 are profiled to compliment its bearing surface 7 this gives a greater area of contact between the locking bar and the coupling half. Either or both the receiving 19 or bearing surfaces 7 may be profiled.

Each locking bar 8 has its apertures spaced so that when the receiving surfaces 16 are engaged on their respective bearing surfaces 7 the locking bar will sit approximately at mid height on the bearing surface 7. In the preferred embodiment the upper locking bar sits below the surface of the entrance to the aperture 6. The apertures in the locking bars 8 are sized so that when engaged there is a gap 103 between the aperture and the straight side 102 of the post 101.

The lower locking bar 8B is of slightly longer length between distal ends to allow it to fall to the lower bearing surface 7B before engaging and thus it will clear the upper bearing surface 7A. The upper locking bar 8A is shorter to fall into the aperture 6 and engage only the upper bearing surface 7A and thus be stopped there.

The aperture 6 is substantially closed at the bottom and the bottom is of sufficient strength to support the posts 101.

The location of the locking bars 8 on the post 101 of two adjacent half couplings will create a rigid join between the adjacent pontoons 10. The pontoons then cannot move in any of the three directions 10.

The presence of the frictional interface 4 between adjacent couplings increases the rigidity of the interface. The couplings each have complimentary recesses 17 and projections 18 arrayed either side of the vertical slot 9. For example the upper left hand side of one half coupling may have a projection 18 and the mating other half coupling will have a complimentary projection. Thus when the two half couplings are brought together the recesses and projections engage and impart further rigidity to the frictional interface. The engagement adds torsional rigidity and helps prevent relative movement in all three directions.

Figure 7:
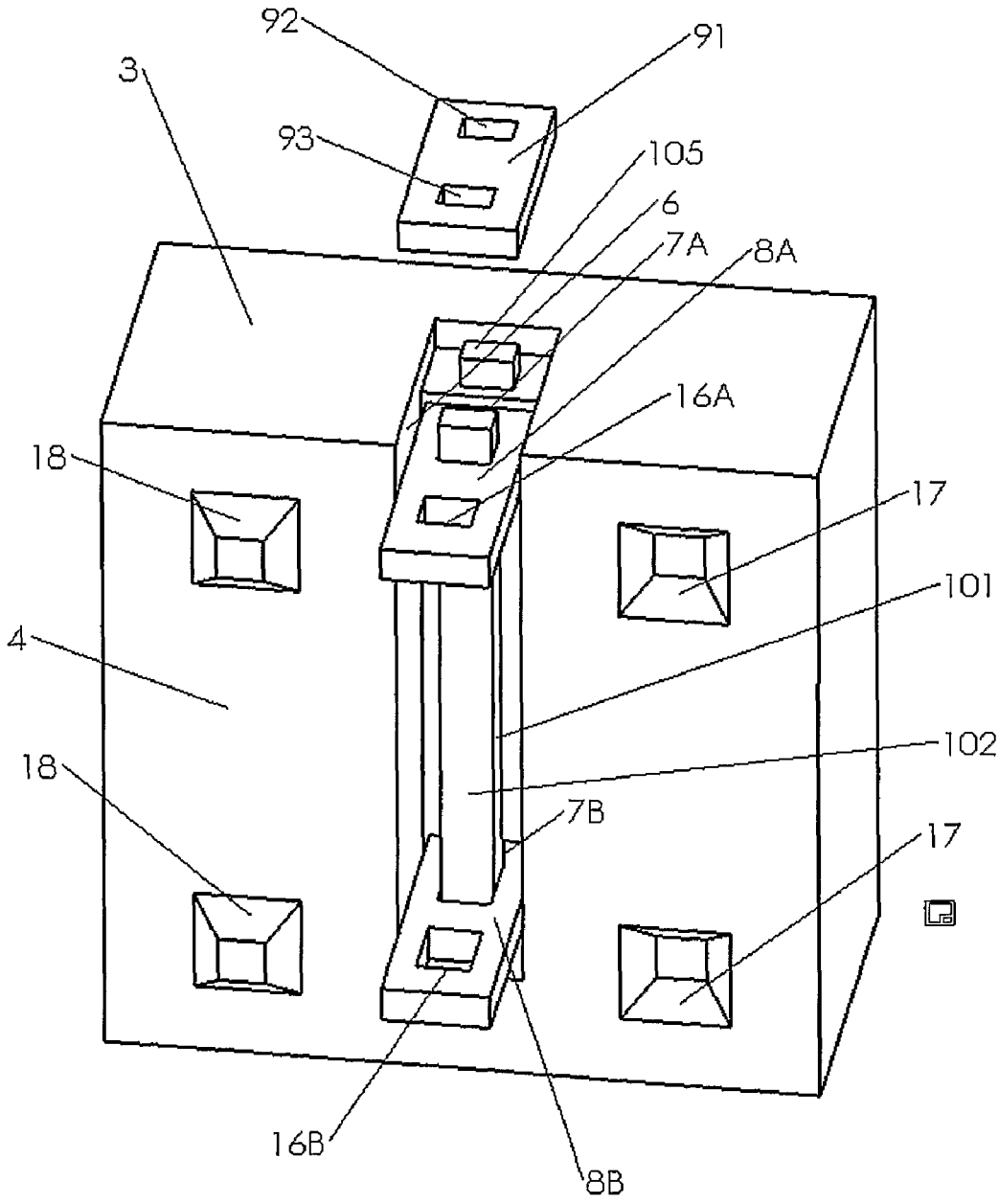
FIG. 7 shows an isometric view of a coupling portion/half of an alternate embodiment of the present invention and locking members engaged therein.
Figure 8:
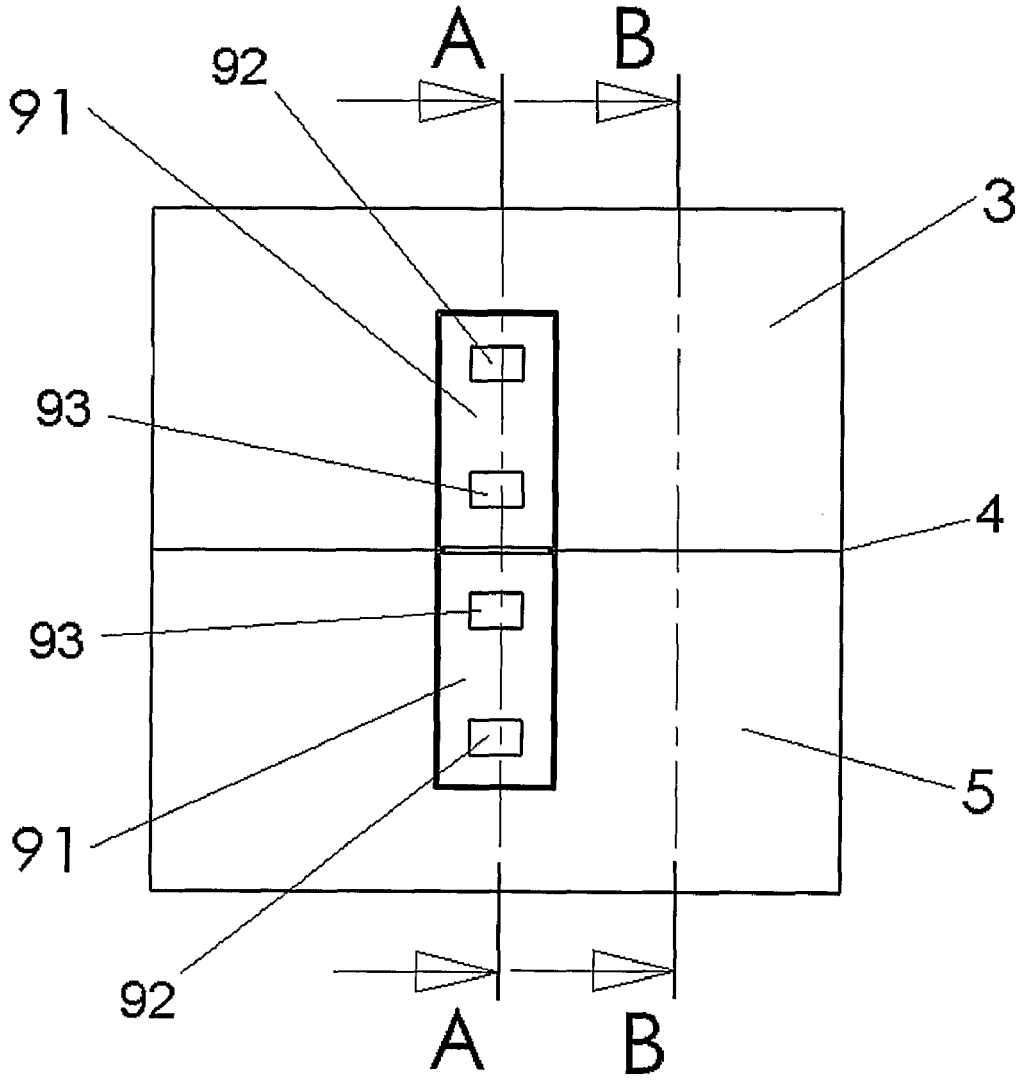
FIG. 8 shows a plan view of a pair of coupling portions/halves illustrated in FIG. 7 showing the two coupling portions/halves and locking members engaged therein.

There may be energy absorbing material between a recess 81 and its complimentary projection 82 as illustrated in FIG. 1, but not illustrated in FIG. 7. The locking bars and coupling halves are made from in the preferred embodiment high tensile steel, although other suitable materials may be used.

To increase the rigidity of post 101 a further elongated bar 91 is fitted over post 101 and a further post 105. The elongated bar 91 has through apertures 92, 93 which are fitted to the shape of the top of the posts 101. The bar 91 when fitted sits flush with the surface of the pontoon 10. In an alternate embodiment the elongated bar 91 may only have partial apertures 92, 93 and the posts 101 and 105 may end below the surface of the pontoon 10, but be off sufficient height to engage the bar 91 and allow the bar 91 to sit flush with the surface of the pontoon 10.

A gap 104 between the securing bars 91 at the abutting plane 4 ensure that the bars 91 are not distorted as the marine bodies 10 close in on each other.

Method of Assembly

Two adjacent pontoons are brought into proximity with one another. Once the two half couplings are sufficiently aligned and close to one another the locking bars 8 can be located in the apertures 6. The two locking bars have different length; the lower one is slightly longer than the upper one. The lower bar can drop from top until stopped by the lower slope (see FIG. 3), while the upper bar can only fall a small distance, as it will be stopped by the upper slope due to its shorter length. The friction forces between the locking bars and slopes, together with gravitational forces, keep the bars in position, which are translated to pre-tension forces in the axial of the bars. The pretension forces bring the two connector bases together tightly.

To disassemble the procedure is reversed. An external upwards force can overcome the gravitational force and release the friction forces, which allows the bars to be removed easily. In the preferred form of the present invention there are two or more set of couplings at each surface of the pontoon to be joined. This imparts further rigidity both rotationally and translationally to the join.

The first and second coupling halves are for example provided on a vertical side face of each of the first and second pontoons and as the pontoons are brought more proximate to each other, the projections and recesses of the first coupling half will at least in part become located within the complimentary recesses and projections of the second coupling half. As the pontoons are brought more proximate to each other this location prevents relative movement in the first and third directions. As the pontoons may be assembled in an end-end relationship in sea states where relative movement between the two pontoons occurs, the relationship between the first coupling halves is such that a guiding engagement occurs. At the initial stages of engagement, the fit between the coupling halves is relatively loose and the pontoons can move in a limited manner in the first and third directions relative to each other.

Significant movement between the two pontoons is induced by variation in the waterline level as result of the wave action (and a relative movement of the two pontoons hence being in the Z direction). The taper of the bearing surfaces (and thus the receiving surfaces) is provided to decrease the degree of freedom of movement in the Z direction between the two pontoons during the engagement projection as it moves to a stage where the two pontoons are fully engaged. Relative movement of the two half couplings causes the locking bars to creep under action of gravity further down into the aperture. This thus tightens the joins between the two half couplings.

Figure 5:
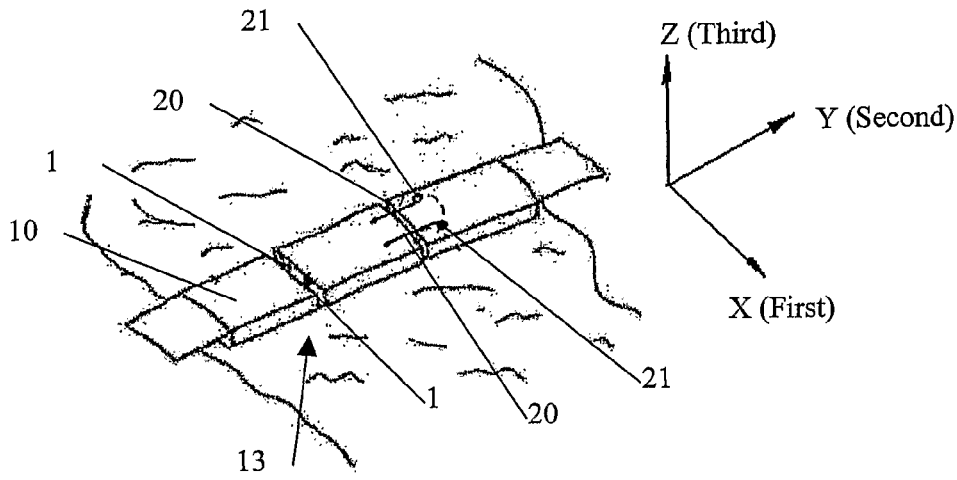
FIG. 5 shows a number of pontoons which have been joined with a coupling system of the present invention across a body of water.
Figure 6:
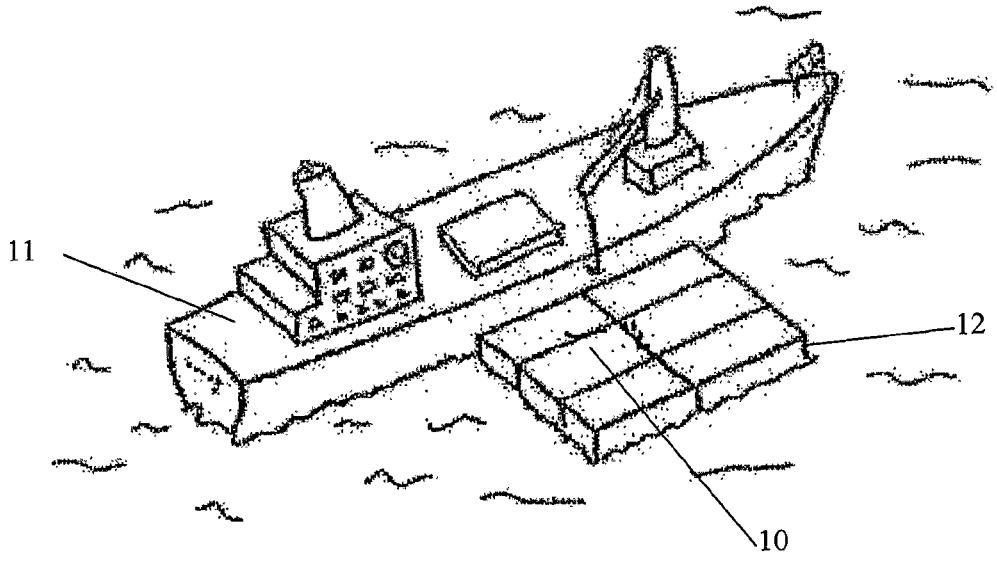
FIG. 6 shows a boat deploying a number of buoyant marine bodies having the coupling system of the present invention.

The two pontoons may be brought more proximate to each other by the use of a cable or rope or the like 20, which may be rigged as for example shown in FIG. 5. A rope is adjustable in length by a winch 21 to draw the two pontoons together. The rope may be provided at deck level (above the position of the first second coupling halves) and by the winding of the winch can draw the two pontoons (in the Y direction closer together). This rope may also to some extent create an alignment in the X direction between the two pontoons.

The recesses 17 and projections 18 are of a nature such that when they are fully engaged, no movement between the two pontoons in at least the Z direction (and preferably also the X direction) can occur. In fact the shear loading that is created by the differential forces applied to the pontoons by the sea state in both the Z direction and X direction is carried by this complimentary engagement. When the pontoons, in the Y direction, are in an engaged condition, the recess 17 locates without any significant freedom of movement in the X and Z directions in the projection 18.

In the arrangement shown in FIG. 1 one first male and one first female coupling members are provided positioned adjacent each other and preferably axially aligned along the X direction axis, a pair of female second coupling members may be provided adjacent the longitudinal ends of the first female coupling members and a pair of second male coupling members may be provided at the longitudinal ends of the first male coupling member. It will be appreciated that conversely the first male coupling member 2 may be flank by two second female coupling members or a combination of such.

Once the pontoons are in an engaged condition, they may be held in such a relationship to prevent movement apart from each other in the Y direction, by the use of fastening means 10. Such fastening means can span between the two pontoons and engage the two pontoons axially together to thereby prevent relative movement of the two pontoons at least to a significant degree in the Y direction. Relative movement of the two half couplings causes the locking bars to creep under action of gravity further down into the aperture. This thus tightens the joins between the two half couplings.

Assembly and disassembly of the alternate embodiment illustrated in FIGS. 7 to 11 is similar, however once the locking bars 8 are in place the securing bar 91 is also fitted. Optionally the securing bar may be secured to the pontoon by bolts, rivets or wilding. To remove the locking bars 8 it is first necessary to remove the securing bar 91.

The invention described and shown can provide 1) impact attenuation; 2) pre-alignment; 3) stable engagement in vertical and longitudinal directions. It is a revision of the embodiment of Singapore Patent No. 109504 (published as WO 2004024555 on 25 Mar. 2004), which is included here by way of reference. This revision provides a 6 Degree-of-Freedom (DOF) constraint, translation in the 3 directions, and rotation about each of these. The whole engagement is efficient and robust, and provides a complete rigid connection between two mating connectors or pontoons with pairs of the connectors installed. With these features, pontoons can be joined together and float as a single rigid body in water to form a large stable floating working surface for various purposes.

The foregoing description of the invention includes preferred forms thereof. Modifications may be made thereto without departing from the scope of the invention.

The invention claimed is:

1. A coupling to engage and retain two adjacent buoyant marine bodies in a side to side abutting relationship, said coupling comprising:

a first coupling portion and a second coupling portion, one each on one of said two adjacent buoyant marine bodies;

at least said first coupling portion including a downwardly directed receiving recess that includes at least one bearing surface that faces away from a plane of abutment of said two marine bodies and that increases in distance away from said plane of abutment from top to bottom; and a locking bar to be retained by said second coupling portion in a manner to allow it to move vertically thereto and to project from said second coupling portion for engagement with said first coupling portion, said locking bar including a receiving surface to abut with said bearing surface, wherein relative movement of said two marine bodies together causes said locking bar to drop down said receiving recess thereby holding said two marine bodies together, in more restrained juxtaposition, wherein there are two locking bars per recess, a shorter upper locking bar, and a longer lower locking bar.

2. The coupling to engage and retain two adjacent buoyant marine bodies in a side to side abutting relationship as claimed in claim 1 wherein said longer lower locking bar passes an upper region of said recess and comes to settle at a lower region of the recess.

3. The coupling to engage and retain two adjacent buoyant marine bodies in a side to side abutting relationship as claimed in claim 1, wherein said shorter upper locking bar engages the recess at its upper region.

4. The coupling to engage and retain two adjacent buoyant marine bodies in a side to side abutting relationship as claimed in claim 1, wherein said marine bodies are restrained from movement in one of directions parallel to the plane of abutment and directions perpendicular to the plane of abutment.

5. The coupling to engage and retain two adjacent buoyant marine bodies in a side to side abutting relationship as claimed in claim 1, wherein said two locking bars resist rotational movement of said two bodies about a horizontal axis parallel to the plane of abutment.

6. The coupling to engage and retain two adjacent buoyant marine bodies in a side to side abutting relationship as claimed in claim 1 wherein said recess provides two said bearing surfaces one either side of said vertical slot, said recess defining a T shape in plan view.

7. The coupling to engage and retain two adjacent buoyant marine bodies in a side to side abutting relationship as claimed in claim 1 wherein both said first and second coupling portions have a T-shaped recess.

8. The coupling to engage and retain two adjacent buoyant marine bodies in a side to side abutting relationship as claimed in claim 1 wherein said locking bars have a T shaped end.

9. The coupling to engage and retain two adjacent buoyant marine bodies in a side to side abutting relationship as claimed in claim 1 wherein said recess has a vertical slot opening through which said locking bar extends, said slot opening being of a length to allow movement downwards of said locking bar.

10. The coupling to engage and retain two adjacent buoyant marine bodies in a side to side abutting relationship as claimed in claim 1, wherein said locking bar is restrained from riding up said recess by friction between said bearing surface and said receiving surface.

11. A floating marine structure, said structure comprising of a plurality of buoyant marine bodies each incorporating at least one coupling as claimed in claim 1.

* * * * *